US005962116A

United States Patent [19]

Triquet et al.

[11] Patent Number: 5,962,116

[45] Date of Patent: Oct. 5, 1999

[54] COPPER STRIP OR SHEET WITH A BROWN COVER LAYER AND METHODS FOR ITS PRODUCTION

[75] Inventors: Christian Triquet, Bissendorf; Wolfgang Denke; Stefan Hoveling, both of Osnabrück; Stefan Priggemeyer, Wallenhorst, all of Germany

[73] Assignee: KM Europa Metal AG, Osnabrück, Germany

[21] Appl. No.: 08/668,675

[22] Filed: Jun. 25, 1996

[30] Foreign Application Priority Data

Jun. 29, 1995 [DE] Germany ..... 195 23 646

[51] Int. Cl.[6] ..... C22C 9/00

[52] U.S. Cl. ..... 428/216; 427/255.1; 427/255.2; 427/255.3; 428/336; 428/469; 428/472; 428/701; 428/702

[58] Field of Search ..... 428/216, 336, 428/701, 702, 469, 472; 427/255.1, 255.2, 255.3

[56] References Cited

U.S. PATENT DOCUMENTS 4,189,331 2/1980 Roy ..... 428/469

5,264,049 11/1993 Yoshida et al. ..... 148/269

5,643,679 7/1997 Ishimaru et al. ..... 428/472

OTHER PUBLICATIONS

Chemical Abstracts, vol. 83, No. 2, Jul. 1975, p. 258, Abstract No. 32184t.

*Primary Examiner*—Archene Turner
*Attorney, Agent, or Firm*—Kenyon & Kenyon

[57] ABSTRACT

A copper strip or sheet having a red-brown to dark brown cover layer. The cover layer includes a first layer of $Cu_2O$ which adheres to the base metal, with a thickness in the range of 0.05 to 5 $\mu$m, preferably in the range of 0.1 to 1 $\mu$m, and a second layer of CuO arranged on top of the first layer, with a thickness between 1 and 100 nm, preferably with a thickness between 10 and 50 nm. The cover layer is applied by heat treating the copper base to form a $Cu_2O$ layer, followed by a second heat treatment to form a CuO layer. Alternatively, the cover layer is applied by heat treating the copper base in an oxygen containing atmosphere followed by treatment with an aqueous solution of a salt which produces an alkali reaction. The resulting copper strip or sheet of the invention is well suited for use in the construction sector.

23 Claims, No Drawings

COPPER STRIP OR SHEET WITH A BROWN COVER LAYER AND METHODS FOR ITS PRODUCTION

BACKGROUND OF THE INVENTION

1. Field of the Invention

The invention relates to a copper strip or sheet with a red-brown to dark brown cover layer for use in the construction sector. The invention is also directed to preferred methods for the production of a brown cover layer on strip-shaped semi-finished products consisting of copper, particularly on rolled strips and sheets for roofing and facade paneling.

2. Description of Related Art

It is known that under normal atmospheric conditions, a firmly adhering and strong cover layer of copper oxide forms on the surface of shiny copper. The oxide film, even though it is very thin at first, stabilizes the surface of the copper material right away, protecting it from the effects of the atmosphere. In an ideal case, the slow continued formation of the oxide layer as the result of the reaction of the copper with moisture and oxygen in the air gradually causes a uniform brown coloration (brown patina) to be formed, with the copper surface increasingly losing its metallic shine. Over time, the brown cover layer becomes darker and darker, and finally changes to an anthracite-brown. This is the final state which usually occurs on vertical building surfaces, such as exterior wall paneling. In the case of inclined roof surfaces, the cover layer continues to change color, reacting with the substances contained in the atmosphere, such as sulfur dioxide, carbon dioxide and chlorides, to form alkaline copper compounds, until the patina green which is typical for copper is reached.

However, under certain atmospheric conditions, the formation of the brown cover layer can be significantly delayed or accelerated in spots, so that as a rule, it is necessary to wait for a relatively long time until uniform discoloration of the copper surface has been achieved. Deviations from uniform coloring are observed, in particular, during the initial stages of weathering. In many cases, non-uniform dark spots and/or strips form on the copper surface at first. Over the further course of weathering due to atmospheric influences, however, these color differences disappear again.

A method for the production of uniform layers of cuprous oxide on the surface of copper wire or strips is mentioned, for example, in Chemical Abstracts, Volume 83, No. 2, July 1975, page 258, Abstract No. 32184t. In this known method, the copper oxide layer is formed by means of oxidizing heat treatment at a temperature lying in the temperature range of 300 to 1000° C.

SUMMARY OF THE INVENTION

It is an object of the invention to provide a copper strip or sheet which initially has a uniform and firmly adhering brown cover layer (brown patina) on its surface, and which is easy to handle and to process, with reduced solubility of copper ions.

It is a further object of the invention to provide a method for the production of a brown cover layer on strip-shaped semi-finished products made of copper.

The invention is a copper strip or sheet having a red-brown to dark brown cover layer. The cover layer includes a first layer of $Cu_2O$ which adheres to the base metal, with a thickness in the range of 0.05 to 5 $\mu$m, preferably in the range of 0.1 to 1 $\mu$m, and a second layer of CuO arranged on top of the first layer, with a thickness between 1 and 100 nm, preferably with a thickness between 10 and 50 nm. The copper strip or sheet of the invention is well suited for use in the construction sector. Since the cover layer is initially on the copper strip, it is not necessary to wait for the long-term effect of the atmosphere.

DETAILED DESCRIPTION OF THE INVENTION

The invention also provides a method for the production of a brown cover layer on strip-shaped semi-finished products consisting of copper, particularly rolled strips or sheets for roofing and facade paneling materials. In accordance with the method:

a) the strip-shaped semi-finished copper product is subjected to a first heat treatment at a temperature lying in the temperature range of 250 to 750° C., for a duration of 0.1 to 5 minutes, in a mixed gas atmosphere containing up to 15% by volume oxygen, to form a $Cu_2O$ layer; and b) subsequent to the first heat treatment according to process step a), the strip-shaped semi-finished copper product is subjected to a second heat treatment under oxidizing conditions, to form a CuO layer, where the second heat treatment is conducted for a duration of 1 to 30 minutes in a temperature range of 200 to 450° C., and where the mixed gas atmosphere has an oxygen content between 10 and 21% by volume.

In another embodiment of the invention there is provided a method for producing a brown cover layer on a strip-shaped semi-finished copper product, comprising the steps of:

a) heat treating the strip-shaped semi-finished copper product at a temperature lying in a range of 250 to 750° C., for a duration of 0.1 to 5 minutes, in a mixed gas atmosphere with an oxygen content of 1 to 21% by volume; and subsequently b) treating the strip-shaped semi-finished copper product with an aqueous solution of a salt which produces an alkali reaction.

Advantageous preferred embodiments of the invention are evident from the Examples herein.

Using the method according to the invention, it is possible, in surprisingly easy manner, to achieve pre-weathering (brown patina) of the surface of semi-finished products consisting of copper, in the plant, without having to wait for the dark brown discoloration of the copper surface which is dependent on the long-term effect of atmospheric influences. This advantage particularly meets the aesthetic need for uniform coloring of the copper surface, for example in the case of a roof covering or facade paneling composed of shaped copper elements. A significant advantage can also be seen in that it is possible to provide the installer with copper strips or sheets that have a brown patina, if any repair work becomes necessary. This pre-patinated material then allows inclusion in facade paneling which has already been exposed to atmospheric influences for some time, without any differences with regard to coloring and shading of the brown cover layers on the individual facade elements becoming evident.

It has furthermore been shown that the pre-patinated strips or sheets of copper produced according to the method of the invention have cover layers which not only have excellent adhesion strength, but also remain resistant to deformation when they are bent or folded, i.e. do not come off. Even the finger marks which are frequently unavoidable during the installation of roof covering and facade paneling materials are not really obvious on the pre-patinated surface.

Improved adhesion strength of the cover layer and an even more uniform brown coloration of the pre-patinated copper surface can be achieved by carrying out the second heat treatment under an atmosphere containing a defined oxygen content, directly after the first heat treatment, to form the CuO layer. In addition, the $Cu_2O$ layer acts as an adhesion mediator for the CuO layer. The $Cu_2O$ layer protects the copper sheet against local corrosion, while the CuO layer is responsible for reducing surface corrosion (copper ion solubility) caused by acidic rain water or other media aggressive for copper.

Surprisingly, chemical post-oxidation with an aqueous solution of a salt which produces an alkali reaction, alone or in combination with a salt of the group comprising inorganic peroxides, organic peroxides and oxychloric acids, leads to the same result.

In principle, numerous chemical and electrolytic methods for coloring copper surfaces brown are already known. However, without the prior thermal pre-oxidation step, particularly under large-scale technical production conditions, these lead to insufficient color saturation of the cover layers. Furthermore, it can generally not be avoided that spots and smears remain on the surface, for example in the case of treatment solutions applied by means of dip treatment.

The invention will be explained in even greater detail below, using several exemplary embodiments which should be regarded in an illustrative, rather than a restrictive, sense.

Exemplary Embodiment 1

A cold-rolled and, if necessary, degreased strip of SF-copper pursuant to DIN 1787 with a thickness of 0.6 mm and a width of 100 mm (Sample 1) was uniformly roughed up using a rough working roll. The mean roughness of the surface of the copper strip was 5 $\mu$m. The copper strip was then conveyed for heat treatment to a laboratory oven, the operating temperature of which was set to approximately 480° C. For surface oxidation of the copper strip, a controlled gas atmosphere of nitrogen with 2% by volume oxygen was adjusted in the oven chamber, and the copper strip was kept under these conditions for 5 minutes. After this heat treatment, Sample 1 was cooled to room temperature in a cooling chamber under protective gas, for example argon. The heat-treated copper strip demonstrated an even, red, approximately 1 $\mu$m thick $Cu_2O$ oxide layer, the crystals of which had a mean grain size of 0.05 $\mu$m. Subsequently, Sample 1 was subjected to a second heat treatment at a temperature of 300° C., in a mixed gas atmosphere with a higher oxygen content than in the first heat treatment, for example atmospheric air. With this second heat treatment, a thin, dark brown CuO oxide layer with a thickness of approximately 0.05 $\mu$m formed on the surface of the $Cu_2O$ intermediate layer.

Usually, CuO layers on copper surfaces are black and consist of tenorite crystals. If, however, a thin CuO layer is formed on a red $Cu_2O$ intermediate layer by means of a targeted second heat treatment or by means of chemical post-oxidation, the color values of the two oxide layers combine to yield the desired red-brown to dark brown cover layer.

If the thickness of the $Cu_2O$ intermediate layer is below 0.05 $\mu$m, the proportion of the red color is too slight to achieve a dark brown color of the cover layer together with the CuO layer. If, however, the thickness of the $Cu_2O$ intermediate layer (cuprite) is greater than 5 $\mu$m, the adhesion of this intermediate layer is detrimentally reduced and the ability of the layer to withstand deformation is no longer guaranteed. In total, the best properties with regard to color, adhesion and deformability occur in a thickness range of the intermediate layer between 0.2 and 0.7 $\mu$m.

Exemplary Embodiment 2

In a variation of Exemplary Embodiment 1, a copper sheet designated as Sample 2 was cold-formed by 20% after the first heat treatment, and then subjected to a second 10-minute heat treatment at 350° C., to produce a thin, dark brown CuO layer.

Exemplary Embodiment 3

In a further variation of Exemplary Embodiment 1, a copper sheet designated as Sample 3 was first subjected to heat treatment to form the $Cu_2O$ intermediate layer, for 1.5 min at 550° C., and then to form a thin CuO layer, for 10 min at 350° C., under oxidizing conditions. After these two heat treatments, Sample 3 was cold-formed by about 10% to increase its strength.

After these treatment steps, all the samples had a very uniform cover layer with an intense dark brown color. The brown patina proved to be very resistant to wear. Even after supplemental bending and folding operations, there was no damage to the cover layer, nor could any loosening of the cover layer be observed.

Exemplary Embodiment 4

A cold-rolled strip of SF-Cu (hard-rolled state) pursuant to DIN 1787 with a thickness of 0.63 mm and a width of 1000 mm was subjected to recrystallization annealing with simultaneous surface oxidation in a continuous furnace. The heat treatment took place above the recrystallization temperature of the copper strip, in a controlled gas atmosphere with approximately 5% oxygen. Immediately after the annealing process, the copper strip was conveyed through an oxidation bath which had been heated to approximately 70° C. and consisted of a mixture of approximately 40 g/L soda lye and approximately 20 g/L potassium peroxodisulfate. Subsequently, the copper strip was rinsed with water and dried with hot air. It was possible to determine the dwell times of the copper strip in the continuous oven and in the chemical oxidation bath by means of the time required for soft annealing. After these treatment steps, the copper strip had a uniform, red-brown to dark brown cover layer. Under the raster electron microscope, the thickness of the $Cu_2O$ layer was determined to be 0.7 $\mu$m, while the thickness of the CuO layer was approximately 0.05 $\mu$m.

To increase its strength, the copper strip can subsequently be rolled half-hard. There was no damage or loosening of the cover layer during this step nor during supplemental bending or folding operations.

What is claimed is:

1. A copper strip or sheet with a red-brown to dark brown cover layer, comprising a copper base and a cover layer disposed on the copper base, the cover layer including a first layer consisting essentially of $Cu_2O$ adhering to the copper base, with a thickness of 0.05 to 5 $\mu$m, and a second layer consisting essentially of CuO arranged on top of the fist layer of $Cu_2O$, with a thickness between 1 and 100 nm.

2. The copper strip or sheet according to claim 1, wherein the thickness of the $Cu_2O$ layer is from 0.1 to 1 $\mu$m and the thickness of the CuO layer is between 10 and 50 nm.

3. The copper strip or sheet according to claim 1, wherein the $Cu_2O$ layer is comprised of crystals having a grain size of 0.005 to 0.5 $\mu$m.

4. The copper strip or sheet according to claim 3 wherein the $Cu_2O$ crystals have a mean grain size of about 0.05 $\mu$m.

5. A method for the producing a brown cover layer on a strip-shaped semi-finished copper product comprising the steps of:

a) subjecting the strip-shaped semi-finished copper product to a first heat treatment at a temperature in a range of 250 to 750° C., for a duration of 0.1 to 5 minutes, in a mixed gas atmosphere containing up to 15% by volume oxygen, to form a $Cu_2O$ layer; and subsequently b) subjecting the strip-shaped semi-finished copper product to a second heat treatment under oxidizing conditions, to form a CuO layer, where the second heat treatment is conducted for a duration of 1 to 30 minutes at a temperature range of 200 to 450° C. and in a mixed gas atmosphere having an oxygen content between 10 and 21% by volume.

6. The method according to claim 5, further comprising the step of structuring at least one surface of the strip-shaped semi-finished copper product by means of textured rolls, before the first heat treatment.

7. The method according to claim 5, wherein the first heat treatment is carried out at a temperature between 150 and 600° C.

8. The method according to claim 5, wherein the oxygen content of the mixed gas atmosphere used in the first heat treatment is 3 to 10% by volume.

9. The method according to claim 5, further comprising the step of subjecting the strip-shaped semi-finished copper product to mechanical deformation by up to 40% after the first heat treatment or after the second heat treatment or after each of both heat treatments.

10. The method according to claim 9, wherein the deformation is between 5 and 7%.

11. The method according to claim 9, wherein the deformation is carried out using textured working rolls.

12. A method for producing a brown cover layer on a strip-shaped semi-finished copper product, comprising the steps of:

a) heat treating the strip-shaped semi-finished copper product at a temperature lying in a range of 250 to 750° C., for a duration of 0.1 to 5 minutes, in a mixed gas atmosphere with an oxygen content of 1 to 21% by volume; and subsequently b) treating the strip-shaped semi-finished copper product with an aqueous solution of a salt which produces an alkali reaction.

13. The method according to claim 12, wherein the aqueous solution contains at least one additional salt selected from the group consisting of inorganic peroxides, organic peroxides and oxychloric acids.

14. The method according to claim 12, further comprising the step of structuring at least one surface of the strip-shaped semi-finished copper product by means of textured rolls, before heat treating.

15. The method according to claim 12, wherein the heat treatment is carried out at a temperature between 150 and 600° C.

16. The method according to claim 12, wherein the oxygen content of the mixed gas atmosphere used in the heat treatment is 3 to 10% by volume.

17. The method according to claim 12, wherein the aqueous treatment solution has a pH greater than 8.

18. The method according to claim 17, wherein the pH of the treatment solution is between 10 and 14.

19. The method according to claim 12, wherein the aqueous treatment solution has a temperature of 30 to 90° C. and wherein the solution treatment takes place for a period between 15 and 120 seconds.

20. The method according to claim 12, wherein the strip-shaped semi-finished copper product is treated electrolytically in the aqueous solution, wherein the semi-finished copper product acts as an anode.

21. The method according to claim 20, wherein an electrical current with a current density of 1 to 20 $A/dm^2$ flows through the anode.

22. The method according to claim 12, further comprising the step of subjecting the strip-shaped semi-finished copper product to mechanical deformation by up to 40% after process step a) or after process step b) or after each of process steps a) and b).

23. The method according to claim 22, wherein the deformation is between 5 and 7%.

* * * * *